US009743186B2

(12) United States Patent
Takeda et al.

(10) Patent No.: US 9,743,186 B2
(45) **Date of Patent: *Aug. 22, 2017**

(54) SOUND REPRODUCTION DEVICE

(71) Applicant: PANASONIC CORPORATION, Osaka (JP)

(72) Inventors: Katsu Takeda, Osaka (JP); Fumiyasu Konno, Osaka (JP); Susumu Fukushima, Osaka (JP); Rihito Shoji, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 308 days.

This patent is subject to a terminal disclaimer.

(21) Appl. No.: 14/257,964

(22) Filed: Apr. 21, 2014

(65) Prior Publication Data

US 2014/0241552 A1 Aug. 28, 2014

Related U.S. Application Data

(63) Continuation of application No. 13/820,441, filed as application No. PCT/JP2011/003978 on Jul. 12, 2011, now Pat. No. 8,750,543.

(30) Foreign Application Priority Data

Sep. 8, 2010 (JP) ..... 2010-200657

(51) Int. Cl.
*H04R 5/02* (2006.01)

(52) U.S. Cl.
CPC ..... *H04R 5/02* (2013.01); *H04R 2217/03* (2013.01); *H04S 2400/01* (2013.01)

(58) Field of Classification Search
CPC . H04R 1/26; H04R 1/323; H04R 5/02; H04R 2499/15; H04R 2217/03; H04R 3/12; H04S 1/002; H04S 7/302; H04S 2400/01
(Continued)

(56) References Cited

U.S. PATENT DOCUMENTS 4,832,489 A 5/1989 Wyant et al.
5,708,719 A 1/1998 Greenberger et al.
(Continued)

FOREIGN PATENT DOCUMENTS

JP 2-230898 A 9/1990
JP 2523366 B2 8/1996
(Continued)

OTHER PUBLICATIONS

International Search Report issued in International Patent Application No. PCT/JP2011/003978 dated Sep. 27, 2011.
(Continued)

*Primary Examiner* — Vivian Chin
*Assistant Examiner* — Con P Tran
(74) *Attorney, Agent, or Firm* — McDermott Will & Emery LLP

(57) ABSTRACT

Provided is a sound reproduction device including a loudspeaker and a superdirective speaker. The loudspeaker is configured so that a sound pressure of audible sound produced therefrom decreases as the sound travels farther away from the loudspeaker. The superdirective speaker is configured so that a sound pressure of audible sound produced therefrom has a peak at a predetermined distance from the superdirective speaker, and is configured to use an ultrasonic wave as a carrier wave. The loudspeaker and the superdirective speaker are positioned such that a loudspeaker sound field of the audible sound produced from the loudspeaker and a superdirective speaker sound field of the audible sound
(Continued)

produced from the superdirective speaker overlap with each other at a position of a listener.

12 Claims, 12 Drawing Sheets

(58) Field of Classification Search
USPC ..... 381/303, 307, 300, 77, 79, 387
See application file for complete search history.

(56) References Cited

U.S. PATENT DOCUMENTS

| | | | | |
|---|---|---|---|---|
| 5,930,370 | A | 7/1999 | Ruzicka | |
| 2004/0247140 | A1 | 12/2004 | Norris et al. | |
| 2007/0183618 | A1 | 8/2007 | Ishii et al. | |
| 2008/0106701 | A1 | 5/2008 | Yamaoka et al. | |
| 2011/0044467 | A1* | 2/2011 | Pompei ..... | H04R 5/02 381/77 |
| 2012/0076306 | A1 | 3/2012 | Aarts et al. | |

FOREIGN PATENT DOCUMENTS

| | | | |
|---|---|---|---|
| JP | 11-004500 | A | 1/1999 |
| JP | 2000-036993 | A | 2/2000 |
| JP | 2000-152123 | A | 5/2000 |
| JP | 2002-027586 | A | 1/2002 |
| JP | 3252803 | B2 | 2/2002 |
| JP | 2003-110513 | A | 4/2003 |
| JP | 2005-142746 | A | 6/2005 |
| JP | 2005-244578 | A | 9/2005 |
| JP | 2006-135779 | A | 5/2006 |
| JP | 2006-352571 | A | 12/2006 |
| JP | 2007-047616 | A | 2/2007 |
| JP | 2007-067514 | A | 3/2007 |
| JP | 2007-181075 | A | 7/2007 |
| JP | 2008-252625 | A | 10/2008 |
| JP | 2011-103543 | A | 5/2011 |
| JP | 4755451 | B2 | 8/2011 |
| JP | 2012-529215 | A | 11/2012 |
| WO | 2005/076661 | A1 | 8/2005 |

OTHER PUBLICATIONS

Chinese Search Report issued in Chinese Application No. 201180043163.2 dated Sep. 5, 2013, 1 page.

Non-Final Office Action issued in U.S. Appl. No. 13/820,441 dated Oct. 10, 2013.

Notice of Allowance issued in U.S. Appl. No. 13/820,441 dated Mar. 26, 2014.

* cited by examiner

SOUND REPRODUCTION DEVICE

RELATED APPLICATIONS

This application is a Continuation of application Ser. No. 13/820,441, filed on Mar. 1, 2013, now U.S. Pat. No. 8,750,543, which is the U.S. National Phase under 35 U.S.C. §371 of International Application No. PCT/JP2011/003978, filed on Jul. 12, 2011, which in turn claims the benefit of Japanese Application No. 2010-200657, filed on Sep. 8, 2010, the disclosures of which Applications are incorporated by reference herein.

TECHNICAL FIELD

The present invention relates to a sound reproduction device that produces a three-dimensional sound field.

BACKGROUND ART

Conventionally, in order to produce a three-dimensional sound field, there have been proposed many surround sound speaker systems of a type in which a plurality of speakers are provided around a listener. One of such systems is described in Unexamined Japanese Patent Publication No. H11-4500. FIG. 10 is a block diagram of a conventional surround sound speaker system, and a position and a facing direction of a viewer/listener are also shown in FIG. 10. FIG. 10 illustrates a system in combination with video images.

To television set 201 that presents a video image, interconnection module 203 is connected. With this, a sound signal of television set 201 is outputted to interconnection module 203. To interconnection module 203, subwoofer bass speaker 205, as well as front-center speaker 207, left-satellite speaker 209, right-satellite speaker 211, and rear-ambience speaker 213 that are respectively positioned front-side, left-side, right-side, and rear-side of viewer/listener 215 are connected. Therefore, interconnection module 203 has a function of generating various signals including, in addition to right and left sound signals, a sum signal of the right and left sound signals, and a difference signal between the right and left sound signals, and of outputting these signals to the five speakers.

Sound pressure P when a sound signal is emitted from each speaker in such a configuration is shown in FIG. 11A and FIG. 11B. Here, FIG. 11A is a characteristic diagram of sound pressure P of audible sound at distance d from television set 201 and front-center speaker 207 to a position of viewer/listener 215 in a front-back direction represented by line Y-Y. FIG. 11B is a characteristic diagram of sound pressure P along an interval between left-satellite speaker 209 and right-satellite speaker 211 through the position of viewer/listener 215, that is, distance w in a right-left direction represented by line X-X. In both of the figures, sound pressure P emitted from each speaker is shown normalized such that its maximum value takes 1.

Typically, a conventional speaker is called as a dynamic speaker, and configured such that a permanent magnet is provided within a yoke constituted by a magnetic body such as iron, and a magnetic field is produced by converging magnetic flux of the permanent magnet around a voice coil based on a configuration of the yoke. At this time, supplying an alternating current to the voice coil causes the voice coil to vibrate receiving a Lorentz force from the magnetic field produced by the yoke in a vertical direction (thickness direction of the yoke), and thus causes air to vibrate via a diaphragm, also called as a corn, connected to this voice coil, and whereby sound is produced.

Therefore, the sound pressure produced from the normal speaker is maximized near the speaker and decays in the process of the sound propagating through the air due to absorption and diffusion to the air, and thus the sound pressure decreases as the distance from the speaker increases.

Further, as an angle of an aperture of the diaphragm with respect to a sound axis lying along a direction in which sound waves from the speaker travel is large, a directional angle of the sound wave emitted from the normal speaker is often large.

As the speakers that constitute this surround system are normal speakers, sound pressure P of front-center speaker 207 is maximized at a position of front-center speaker 207, and decreases as distance d increases, as illustrated in FIG. 11A. Further, sound pressure P of rear-ambience speaker 213 is also maximized at a position of rear-ambience speaker 213, but decreases as distance d decreases. Specifically, sound pressure characteristics of front-center speaker 207 and rear-ambience speaker 213 at distance d are opposite from each other with respect to the front-back direction of viewer/listener 215. Therefore, as shown by a heavy line in FIG. 11A, superimposed sound pressure P from front-center speaker 207 and rear-ambience speaker 213 is maximized at the position of viewer/listener 215. Here, superimposed sound pressure P emitted from front-center speaker 207 and rear-ambience speaker 213 is also shown normalized such that its maximum value takes 1.

Similarly, as illustrated in FIG. 11B, sound pressure P of left-satellite speaker 209 is maximized at a position of left-satellite speaker 209, and decreases toward the right side within distance w. Further, sound pressure P of right-satellite speaker 211 is maximized at a position of right-satellite speaker 211, and decreases toward the left side within distance w. Thus, sound pressure P of left-satellite speaker 209 and sound pressure P of right-satellite speaker 211 show characteristics opposite from each other with respect to the right-left direction of viewer/listener 215. Therefore, as shown by a heavy line in FIG. 11B, superimposed sound pressure P from left-satellite speaker 209 and right-satellite speaker 211 is maximized at the position of viewer/listener 215.

A combination of the sound pressure characteristics shown in FIG. 11A and FIG. 11B in the front-back direction and in the right-left direction with respect to viewer/listener 215 is as shown in FIG. 12. Sound pressure P is maximized at the position of viewer/listener 215 at distance d in the front-back direction and within distance w in the right-left direction. With this, viewer/listener 215 is able to listen to the sound from front, rear, right, and left, and surrounded by the sound, and thus a three-dimensional effect can be produced.

According to the surround sound speaker system as illustrated in FIG. 10, while a three-dimensional effect can be produced for viewer/listener 215 with this system, it is necessary to provide a large number of speakers around viewer/listener 215, and therefore there is a problem that this system not only occupies a large area, but also makes wiring cumbersome.

CITATION LIST

Patent Literature

Patent Literature 1: Japanese Patent Publication No. 11-4500

SUMMARY OF THE INVENTION

A sound reproduction device according to the present invention includes a loudspeaker and a superdirective speaker. The loudspeaker is configured so that sound pressure P of audible sound produced therefrom decreases as the sound travels farther away from a position of the loudspeaker. The superdirective speaker is configured so that sound pressure P of audible sound produced therefrom has a peak at predetermined distance dk from the superdirective speaker, and is configured to use an ultrasonic wave as a carrier wave. The loudspeaker and the superdirective speaker are positioned such that a loudspeaker sound field of the audible sound produced from the loudspeaker and a superdirective speaker sound field of the audible sound produced from the superdirective speaker overlap with each other at a position of a listener.

According to the sound reproduction device of the present invention, along a sound axis in which the listener faces toward a position where the loudspeaker and the superdirective speaker are positioned, the loudspeaker sound field of the audible sound from the loudspeaker overlaps with the superdirective speaker sound field of the audible sound produced from the superdirective speaker having the peak of sound pressure P of the audible sound at predetermined distance dk from the position of the listener (listening point). Accordingly, sound pressure P of the audible sound near the listener can be maximized based on the loudspeaker sound pressure and the superdirective speaker sound pressure.

Further, along a direction vertical to the sound axis of the loudspeaker and the superdirective speaker, with respect to the listener, the loudspeaker sound field of the audible sound having a wide radiation angle produced from the loudspeaker overlaps with the superdirective speaker sound field of the audible sound having high directionality. Accordingly, similarly to the case of the direction along the sound axis, sound pressure P of the audible sound near the listener can be maximized based on the loudspeaker sound pressure and the superdirective speaker sound pressure.

Therefore, it is possible to realize a sound reproduction device capable of producing a sound field having a three-dimensional effect without providing a large number of loudspeakers around the listener.

Further, a sound reproduction device according to the present invention includes: a plurality of sound source units configured to respectively output sound signals that are independent from each other; a selector electrically connected to the sound source units and configured to receive the sound signals; a loudspeaker electrically connected to an output terminal of the selector; and a superdirective speaker electrically connected to an output terminal of the selector. The loudspeaker is configured so that sound pressure P of audible sound produced therefrom decreases as the sound travels farther away from a position of the loudspeaker. The superdirective speaker is configured so that sound pressure P of audible sound produced therefrom has a peak at predetermined distance dk from the superdirective speaker, and is configured to use an ultrasonic wave as a carrier wave. The loudspeaker and the superdirective speaker are positioned such that a loudspeaker sound field of the audible sound produced from the loudspeaker and a superdirective speaker sound field of the audible sound produced from the superdirective speaker overlap with each other at a position of a listener. The selector has a function of selecting any sound signal, out of the sound signals outputted from the plurality of sound source units, for the loudspeaker and the superdirective speaker.

According to the sound reproduction device of the present invention, the loudspeaker and the superdirective speaker are positioned such that the loudspeaker sound field and the superdirective speaker sound field overlap with each other at the position of the listener, and it is possible to emit the sound signals from the plurality of sound source units by optionally selecting between the loudspeaker and the superdirective speaker. Accordingly, it is possible to realize a sound reproduction device capable of performing an adjustment so that a best suited three-dimensional effect can be produced according to contents of the plurality of sound source units.

DESCRIPTION OF EMBODIMENTS

Hereinafter, exemplary embodiments of the present invention are described with reference to the drawings.

First Exemplary Embodiment

Figure 1:
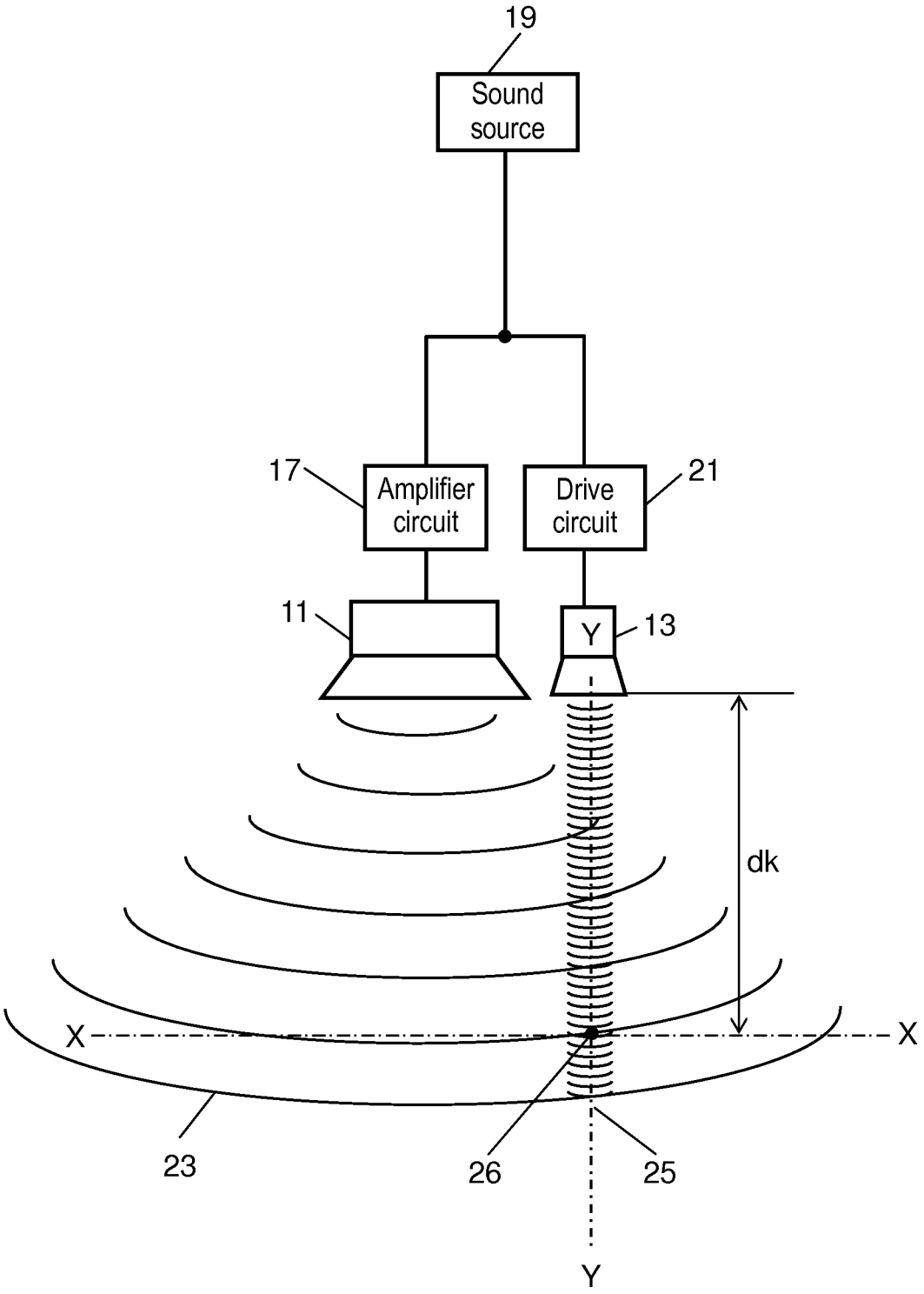
FIG. 1 is a block diagram of a sound reproduction device according to a first exemplary embodiment of the present invention.
Figure 2A:
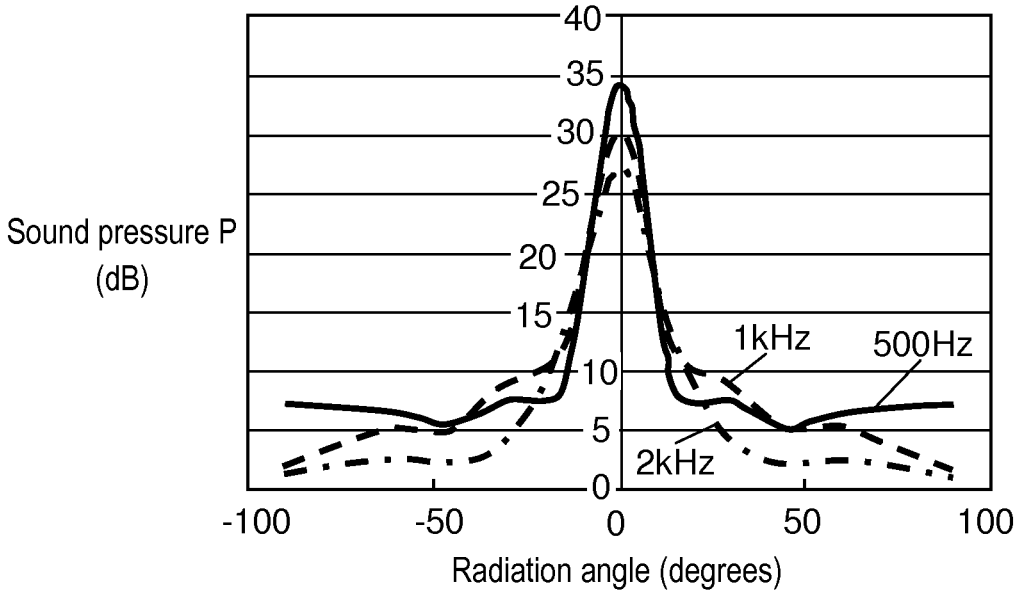
FIG. 2A is a directional characteristic diagram of audible sound from a superdirective speaker according to the first exemplary embodiment of the present invention.
Figure 2B:
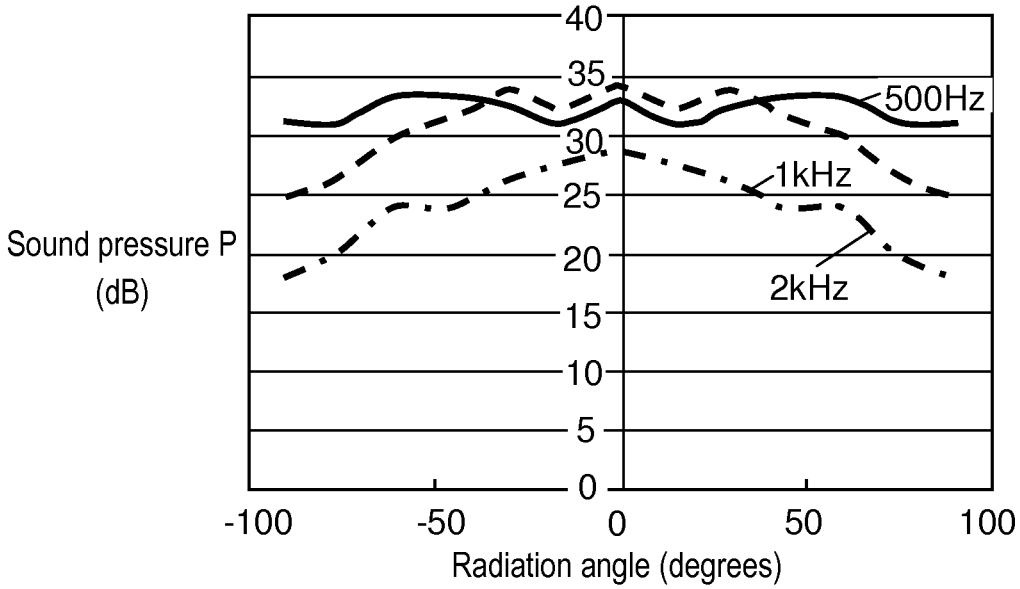
FIG. 2B is a directional characteristic diagram of audible sound from a normal loudspeaker according to the first exemplary embodiment of the present invention.
Figure 3A:
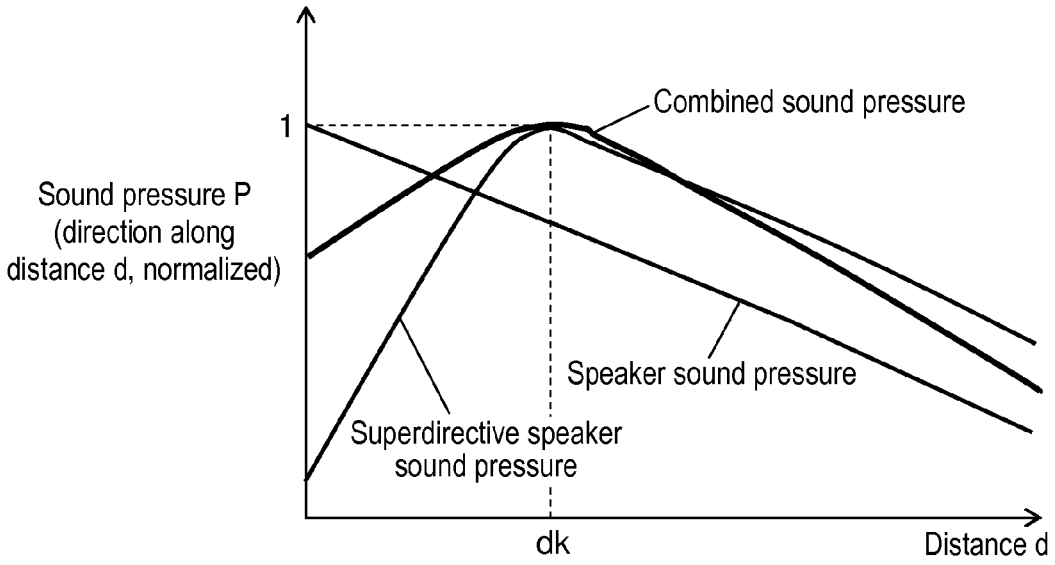
FIG. 3A is a sound pressure characteristic diagram of audible sound of the sound reproduction device according to the first exemplary embodiment of the present invention, with respect to distance d along a sound axis of the audible sound.
Figure 3B:
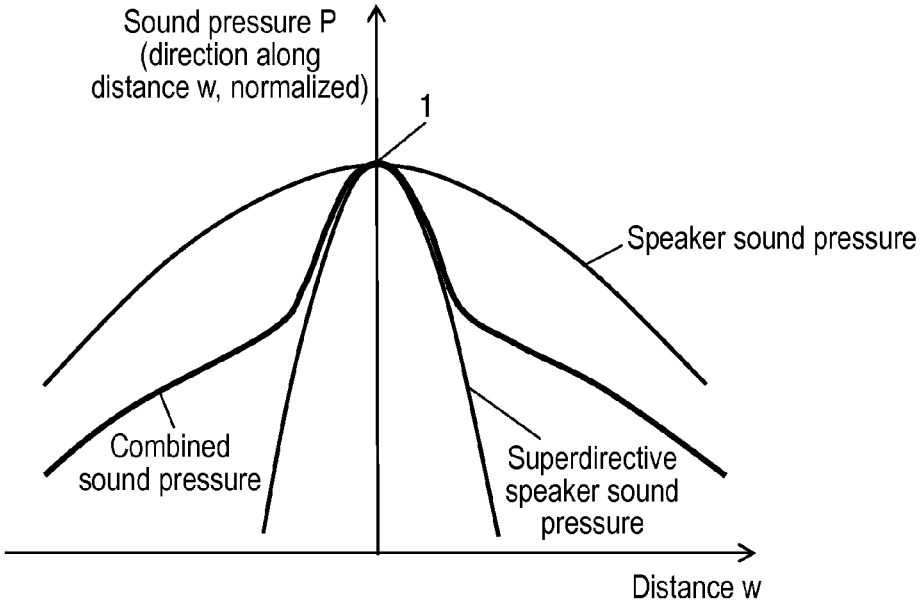
FIG. 3B is a sound pressure characteristic diagram of audible sound of the sound reproduction device according to the first exemplary embodiment of the present invention, with respect to distance w in a direction vertical to the sound axis of the audible sound.
Figure 4:
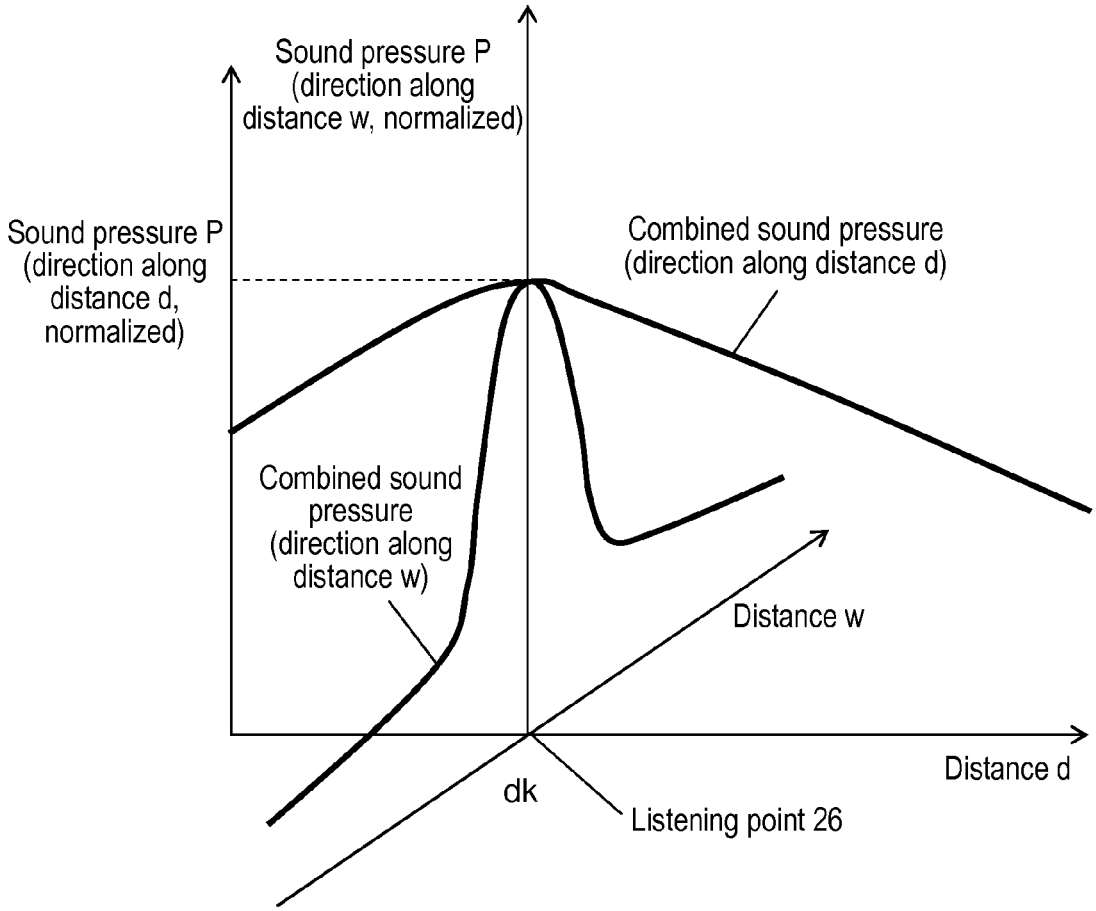
FIG. 4 is a sound pressure characteristic diagram of audible sound of the sound reproduction device according to the first exemplary embodiment of the present invention, with respect to distance d along the sound axis and distance w in the direction vertical to the sound axis.

FIG. 1 is a block diagram of a sound reproduction device according to a first exemplary embodiment of the present invention. FIG. 2A and FIG. 2B are directional characteristic diagram of audible sound from a superdirective speaker and a normal loudspeaker according to the first exemplary embodiment of the present invention; FIG. 2A shows a directional characteristic diagram for the superdirective speaker, and FIG. 2B shows a directional characteristic diagram for the normal loudspeaker. FIG. 3A and FIG. 3B are sound pressure characteristic diagrams of audible sound of the sound reproduction device according to the first exemplary embodiment of the present invention; FIG. 3A shows a sound pressure characteristic diagram of audible sound with respect to distance d from the sound reproduction device along a sound axis in which sound waves travel, and FIG. 3B shows a sound pressure characteristic diagram of audible sound with respect to distance w along a direction vertical to the sound axis. FIG. 4 is a sound pressure characteristic diagram of audible sound of the sound reproduction device according to the first exemplary embodiment of the present invention, with respect to distance d along the sound axis and distance w in the direction vertical to the sound axis.

Referring to FIG. 1, loudspeaker 11 is a conventional speaker having a characteristic that as distance d from loudspeaker 11 along the sound axis increases, sound pressure P of audible sound decreases.

Further, superdirective speaker 13 is positioned side by side near loudspeaker 11. Here, superdirective speaker 13 has a characteristic that sound pressure P of audible sound has a peak at predetermined distance dk from superdirective speaker 13 along the sound axis, and uses ultrasonic waves as carrier waves.

Typically, when a sound wave with an increased amplitude is emitted to a medium such as air or water, as an elastic characteristic of the medium itself (a volume change versus a pressure change) gains a non-linear, instead of linear, characteristic, a waveform of the sound wave is distorted due to an effect of the non-linear characteristic as the sound wave travels through the medium, and consequently the sound wave has come to contain a frequency component that is not originally contained.

Superdirective speaker 13 utilizes such a characteristic. When an audible sound component superimposed over an ultrasonic wave is emitted, due to an influence of the non-linearity of the elastic characteristic of the air, a waveform of the ultrasonic wave as a carrier wave is distorted as it travels through the air and the ultrasonic component having a higher frequency starts to decay first. Thus, the audible sound component having a frequency lower than that of the ultrasonic wave and superimposed over the ultrasonic wave is reproduced.

Accordingly, sound pressure P of the audible sound from superdirective speaker 13 exhibits a characteristic dependent on distance d along the sound axis such that sound pressure P is very small near superdirective speaker 13 along the sound axis in which the sound wave travels, and increases as the audible sound travels through the air to a peak at predetermined distance dk from superdirective speaker 13.

Further, generally speaking regarding directionality of the sound wave, as the frequency of the sound wave is higher, the sound wave propagates without spreading from the sound axis, and therefore an radiation angle becomes smaller and the directionality increases. Accordingly, directionality of the sound wave from the superdirective speaker using, as a carrier wave, the ultrasonic wave having a frequency higher than that of the audible sound is high, and therefore directionality of the audible sound generated in the process of propagation of the ultrasonic wave under the influence of the non-linear characteristic of air is high.

Thus, also in a direction vertical to a sound axis along which the ultrasonic wave propagates, sound pressure P of the audible sound from superdirective speaker 13 exhibits a characteristic dependent on distance w in the direction vertical to the sound axis, such that sound pressure P is large near the sound axis and decreases as the position is farther away from the sound axis.

In the following description, superdirective speaker 13 is defined to be a loudspeaker using the ultrasonic wave as a carrier wave, and loudspeaker 11 is defined to be a loudspeaker that does not uses the ultrasonic wave as a carrier wave.

Predetermined distance dk illustrated in FIG. 1 refers to a distance from a position at which superdirective speaker 13 is positioned to a point at which sound pressure P of audible sound outputted from superdirective speaker 13 shows its peak, that is, a black circle in FIG. 1 (hereinafter referred to as listening point 26). Distance dk is determined according to mechanical characteristics of superdirective speaker 13 and electrical characteristics such as a carrier wave frequency based on the mechanical characteristics.

For example, in a case of superdirective speaker 13 having a carrier frequency at 40 kHz, sound pressure P of the audible sound shows its peak at predetermined distance dk of about 2 m from superdirective speaker 13 in the direction along the sound axis.

Further, as illustrated in FIG. 2A, regarding an radiation angle (horizontal axis in FIG. 2A) with respect to superdirective speaker 13 in the direction vertical to the sound axis, sound pressure P (vertical axis in FIG. 2A) shows its peak on the sound axis (radiation angle=0 degrees) along which the sound wave is emitted, and sound pressure P decreases by 25 dB or more at a position where the radiation angle from the sound axis is 30 degrees.

By contrast, as illustrated in FIG. 2B, a characteristic of sound pressure P in a direction vertical to a sound axis of the sound from loudspeaker 11 is such that sound pressure P does not change largely up to a radiation angle of about 50 degrees from the sound axis, and gradually decreases above 50 degrees. As can be seen from the above, the sound emitted from superdirective speaker 13 has directionality higher than that from loudspeaker 11. FIG. 2A and FIG. 2B show directional characteristics of the audible sound having frequencies of three types at 500 Hz, 1 kHz, and 2 kHz.

Loudspeaker 11 is electrically connected to sound source 19 (such as a television set tuner, a CD player, and a DVD player) via amplifier circuit 17. Further, superdirective speaker 13 is electrically connected to sound source 19 via drive circuit 21. Here, amplifier circuit 17 has functions such as amplification of signals from sound source 19 and control of waveform information of the signals, for example. Further, drive circuit 21 has such functions as of generating ultrasonic waves, superimposing signals from sound source 19 over the generated ultrasonic waves, amplifying amplitudes of the ultrasonic waves, and controlling the waveform information of the ultrasonic waves, for example.

Next, an operation of the sound reproduction device thus configured will be described.

A signal outputted from sound source 19 is inputted to amplifier circuit 17 and drive circuit 21.

The signal from sound source 19 inputted to amplifier circuit 17 is outputted via loudspeaker 11. Loudspeaker sound field 23 of the audible sound produced from loudspeaker 11 propagates through the air at wide angle from loudspeaker 11, as illustrated in FIG. 1. As used herein, loudspeaker sound field 23 of the audible sound produced from loudspeaker 11 is defined to be loudspeaker sound field 23 in which the sound propagates from loudspeaker 11 to listening point 26 without any barrier. Therefore, an influence of sound reflected on a wall surface and such or sound emitted from side and back of loudspeaker 11 is not considered.

On the other hand, the signal from sound source 19 inputted to drive circuit 21 is superimposed over an ultrasonic wave generated in drive circuit 21 and outputted via superdirective speaker 13. As using the ultrasonic wave as a carrier wave, superdirective speaker sound field 25 of the audible sound produced from superdirective speaker 13 has directionality higher than the sound emitted from normal loudspeaker 11. Therefore, as illustrated in FIG. 1, superdirective speaker sound field 25 of the audible sound produced from superdirective speaker 13 propagates through the air substantially linearly from superdirective speaker 13. As used herein, superdirective speaker sound field 25 of the audible sound produced from superdirective speaker 13 is defined to be, similarly to loudspeaker 11, superdirective speaker sound field 25 in which the sound propagates from superdirective speaker 13 to listening point 26 without any barrier.

Positioning loudspeaker 11 and superdirective speaker 13 side by side such that loudspeaker sound field 23 and superdirective speaker sound field 25 having the above characteristics overlap with each other allows a listener positioned at listening point 26 to hear both of the audible sound reproduced from loudspeaker 11 and the audible sound reproduced from superdirective speaker 13 superimposed over each other. A relation between distance d between a position at which each of loudspeaker 11 and superdirective speaker 13 is positioned and listening point 26 (along the sound axis), and sound pressure P of the audible sound from each of loudspeaker 11 and superdirective speaker 13 at distance d at this time is shown in FIG. 3A. Here, a horizontal axis in FIG. 3A (distance d along the sound axis) corresponds to a portion indicated by line Y-Y in FIG. 1. Further, a vertical axis in FIG. 3A and FIG. 3B shows sound pressure P that is normalized taking both of a maximum sound pressure of sound pressure P of the audible sound from loudspeaker 11 and a maximum sound pressure of sound pressure P of the audible sound from superdirective speaker 13 as 1.

As illustrated in FIG. 3A, sound pressure P of the audible sound from loudspeaker 11 has such a characteristic that sound pressure P is maximized at the position at which loudspeaker 11 is positioned and decays as distance d along the sound axis increases. On the other hand, sound pressure P of the audible sound from superdirective speaker 13 has such a characteristic that sound pressure P is small at the position at which superdirective speaker 13 is positioned, increases as distance d along the sound axis increases until peaked at predetermined distance dk, and then decreases as distance d further increases. Consequently, sound pressure P of superimposed audible sound from loudspeaker 11 and superdirective speaker 13 (combined sound pressure) show a characteristic as shown by a heavy line in FIG. 3A. Here, in order to effectively maintain a peak of combined sound pressure P, it is desirable that sound pressure P of the audible sound from superdirective speaker 13 include a portion that is greater than sound pressure P of the audible sound from loudspeaker 11.

Therefore, the audible sound emitted from loudspeaker 11 and superdirective speaker 13 is heard largest when the listener is positioned at predetermined distance dk along the sound axis from the positions at which these loudspeakers are positioned, and becomes smaller if the listener is away from predetermined distance dk.

Now, FIG. 3B shows a sound pressure characteristic of the audible sound with respect to distance w in the direction vertical to the sound axis, that is, the audible sound at a portion indicated by line X-X in FIG. 1. As illustrated in FIG. 3B, sound pressure P of loudspeaker 11 is maximized on the sound axis, and gradually decreases as an absolute value of distance w in the direction vertical to the sound axis increases. By contrast, as illustrated in FIG. 3B, the sound emitted from superdirective speaker 13, as having high directionality as described above, shows maximum sound pressure P on the sound axis, and sound pressure P drops steeply as the absolute value of distance w in the direction vertical to the sound axis increases. Consequently, sound pressure P of the audible sound from loudspeaker 11 and superdirective speaker 13 (combined sound pressure) shows a characteristic as shown by a heavy line in FIG. 3B.

Therefore, the audible sound emitted from loudspeaker 11 and superdirective speaker 13 is heard largest when the listener is positioned on the sound axis with respect to the positions at which these loudspeakers are positioned, and becomes smaller if the listener is away from the sound axis in the direction vertical to the sound axis.

A combination of the sound pressure characteristics of the audible sound shown in FIG. 3A and FIG. 3B is as shown in FIG. 4. Sound pressure P is maximized at listening point 26 both along the sound axis and in the direction vertical to the sound axis. Consequently, the audible sound exhibits a maximum sound pressure near the listener at listening point 26.

As described above, it is possible to realize a three-dimensional sound field that allows the listener to obtain a feeling that the listener is surrounded by sound only with loudspeaker 11 and superdirective speaker 13 that are positioned in the same direction with respect to the listener, without providing a large number of loudspeakers around the listener.

Further, the sound field realized by the configuration of the sound reproduction device according to the first exemplary embodiment is a sound field produced by superimposing loudspeaker sound field 23 and superdirective speaker sound field 25. Accordingly, as compared to a sound field produced only by normal loudspeakers 11, a proportion of interference between the sound from loudspeaker 11 and the sound from superdirective speaker 13 with each other is small.

This is because as the sound field realized by the sound reproduction device is a sound field produced by overlapping the sound field of loudspeaker 11 produced only by an audible sound component with the sound field of the audible sound of superdirective speaker 13 reproduced by using the ultrasonic wave as a carrier wave, the proportion of interference between the audible sound is reduced as compared to the sound field produced from the normal loudspeakers.

Consequently, the listener positioned within the sound field produced by the configuration of the sound reproduction device according to the first exemplary embodiment is able to listen to the sound from superdirective speaker 13 clearly, without being influenced by the sound from loudspeaker 11.

With the configuration and the operation described above, it is possible to realize the sound reproduction device capable of producing a three-dimensional effect for the listener only with loudspeaker 11 and superdirective speaker 13, without providing a large number of loudspeakers around the listener.

While the sound reproduction device according to the first exemplary embodiment is configured such that the same signal from sound source 19 is reproduced from both loudspeaker 11 and superdirective speaker 13, the present invention is not limited to such an example.

For example, there is provided a configuration having a circuit for selecting a loudspeaker for reproduction according to a frequency band of a signal outputted from the sound source such that low-pitched sound is reproduced from loudspeaker 11, and middle-pitched or high-pitched sound is reproduced from superdirective speaker 13. With such a configuration, among sound information included in sound source 19, middle-pitched or high-pitched sound which is a human voice band, as opposed to the background sound a large part of which is low-pitched sound, is reproduced around the listener, and therefore it is possible to provide an effect of increasing clarity of the sound against the background sound.

Second Exemplary Embodiment

Figure 5:
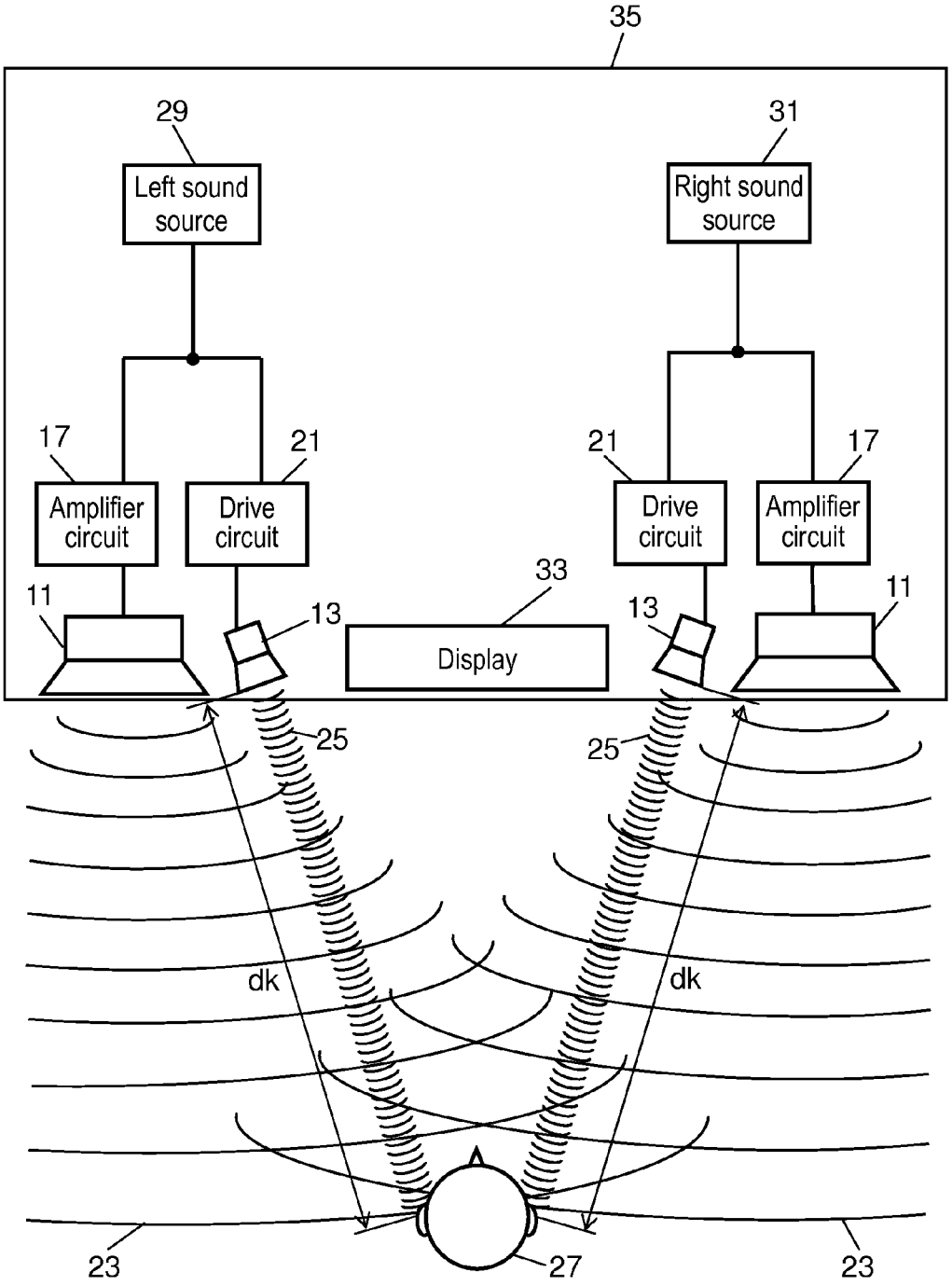
FIG. 5 is a block diagram of a sound reproduction device according to a second exemplary embodiment of the present invention.

FIG. 5 is a block diagram of a sound reproduction device according to a second exemplary embodiment of the present invention, and a position and a facing direction of the listener are also shown in FIG. 5.

In FIG. 5, like reference numerals designate like components as those of the sound reproduction device illustrated in FIG. 1, and detailed descriptions for these components shall be omitted. Specifically, as illustrated in FIG. 5, characteristics of the sound reproduction device according to the second exemplary embodiment are as listed below.

(1) A plurality of loudspeaker pairs (here, two pairs) each including loudspeaker 11 and superdirective speaker 13 positioned side by side with loudspeaker 11 are positioned respectively on the right and left along a front plane that faces against listener 27.

(2) To one of the loudspeaker pairs including loudspeaker 11 and superdirective speaker 13 positioned ahead on the left of listener 27, left sound source 29 that outputs a left sound signal is electrically connected. To the other of the loudspeaker pairs including loudspeaker 11 and superdirective speaker 13 positioned ahead on the right of listener 27, right sound source 31 that outputs a right sound signal is electrically connected. Components such as amplifier circuit 17 and drive circuit 21 are in the same configurations as those in the first exemplary embodiment.

(3) Display 33 is provided between the two loudspeaker pairs. In FIG. 5, components of display 33 such as a display circuit are not shown. Further, the two loudspeaker pairs, accompanying circuits (such as a sound source and a driver/amplifier circuit), and display 33 are built within a single housing, and together constitute television set 35. Therefore, the sound reproduction device according to the second exemplary embodiment has a configuration in which the two loudspeaker pairs are applied to television set 35.

(4) As illustrated in FIG. 5, each of right and left superdirective speakers 13 is positioned side by side with corresponding loudspeaker 11 at an angle so as to face toward listener 27 positioned straight in front of display 33, so that positions in superdirective speaker sound field 25 of peaks of sound pressures P of audible sound outputted from right and left superdirective speakers 13 respectively correspond to positions of right and left ears of listener 27. Therefore, distances d from right and left superdirective speakers 13 to the ears of listener 27 along the sound axis correspond to predetermined distances dk.

Other than the above, the configuration is the same as that of the first exemplary embodiment.

With the above configuration, in addition to a three-dimensional effect for listener 27 in the sound field by a loudspeaker pair including loudspeaker 11 and superdirective speaker 13 as descried in the first exemplary embodiment, three-dimensional effects produced separately in right and left sound fields can also be obtained. Accordingly, as compared to a sound field produced only by normal loudspeakers 11, it is possible to provide a feeling of clearly separated right and left sound, without mixing sound fields in the right-left direction.

Therefore, by configuring the sound reproduction device according to the second exemplary embodiment, it is possible to produce an enhanced three-dimensional effect of sound for listener 27 only by positioning the two loudspeaker pairs each including loudspeaker 11 and superdirective speaker 13 respectively ahead on the right and left of listener 27, without providing a large number of normal loudspeakers around the listener as in the conventional example.

Further, by inputting sound signals linked to a three-dimensional image displayed in display 33 to left sound source 29 and right sound source 31, for example, in television set 35 having such a configuration, a sound field having a three-dimensional effect is produced according to the three-dimensional image, and therefore it is possible to realize television set 35 capable of producing a three-dimensional effect for listener 27 both visually and aurally.

With the configuration and the operation described above, it is possible to realize the right and left sound fields produced from the loudspeaker pairs each including loudspeaker 11 and superdirective speaker 13 respectively around the right and left ears of listener 27, and therefore listener 27 is able to hear sound with a three-dimensional effect separately in right and left. Thus, it is possible to provide the sound reproduction device capable of producing an enhanced three-dimensional effect without providing a large number of normal loudspeakers around listener 27.

While the two loudspeaker pairs are positioned respectively ahead on the right and left of listener 27 according to the second exemplary embodiment, the present invention is not limited to such an example, and it is possible to employ a configuration in which the two loudspeaker pairs are positioned, for example, respectively ahead up and down sides of listener 27 (for example, above and below display 33). Specifically, the two loudspeaker pairs may be positioned such that the sound fields are produced around the right and left ears of listener 27.

Further, the present invention is not limited to the configuration in which the two loudspeaker pairs are built within television set 35, and it is possible to employ a configuration, for example, in which the two loudspeaker pairs are positioned on right and left of display 33 independently from television set 35, or placed within a TV rack.

Moreover, according to the second exemplary embodiment, the two loudspeaker pairs each including loudspeaker 11 and superdirective speaker 13 positioned side by side with loudspeaker 11 are positioned along a single plane (front plane) that faces against listener 27. However, in a case in which these loudspeaker pairs are used, for example, exclusively for sound reproduction, the single plane that faces against the listener is not limited to a front plane, and the loudspeaker pairs may be positioned along any of a side plane, a rear plane, and an upside plane (immediately above the listener). In this case, too, as the loudspeaker pairs are positioned along one of these planes, a three-dimensional effect can be produced for the listener, without providing a large number of loudspeakers as conventionally required.

Third Exemplary Embodiment

Figure 6:
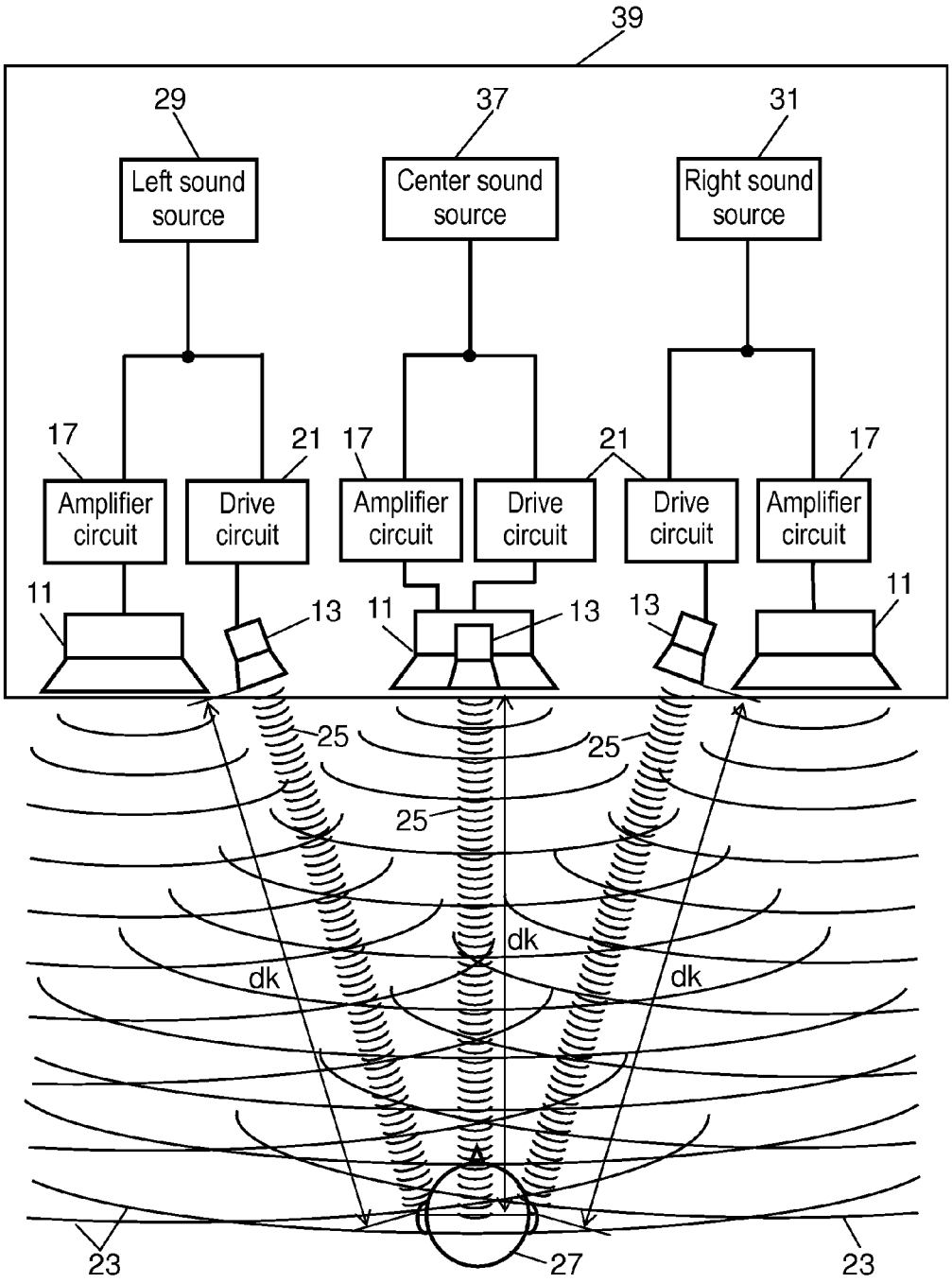
FIG. 6 is a block diagram of a sound reproduction device according to a third exemplary embodiment of the present invention.

FIG. 6 is a block diagram of a sound reproduction device according to a third exemplary embodiment of the present invention, and a position and a facing direction of the listener are also shown in FIG. 6.

In FIG. 6, like reference numerals designate like components as those of the sound reproduction device illustrated in FIG. 5, and detailed descriptions for these components shall be omitted. Specifically, as illustrated in FIG. 6, characteristics of the sound reproduction device according to the third exemplary embodiment are as listed below.

(1) A plurality of loudspeaker pairs (here, three pairs) each including loudspeaker 11 and superdirective speaker 13 positioned side by side with loudspeaker 11 are positioned respectively on the right, left, and center along a front plane that faces against listener 27.

(2) To the loudspeaker pair including loudspeaker 11 and superdirective speaker 13 positioned ahead on the center of listener 27, center sound source 37 that outputs a center sound signal is electrically connected. Therefore, the sound reproduction device according to the third exemplary embodiment is provided with sound sources of three kinds.

(3) TV rack 39 on which the three loudspeaker pairs each including loudspeaker 11 and superdirective speaker 13 are placed is provided. Although the three loudspeaker pairs may be built within television set 35, TV rack 39 is provided herein, considering applications to slim television sets, in particular to slim bezel television sets.

Other than the above, the configuration is the same as that of the second exemplary embodiment.

With the above configuration, in addition to the right and left sound fields produced separately described according to the second exemplary embodiment, it is possible to produce a sound field independent from the right and left sound fields for listener 27 based on sound from the center sound source 37. Therefore, as compared to the conventional surround sound loudspeaker system, it is possible to realize a three-dimensional sound field in which the sound from the loudspeaker pairs on the right, left, and center are independent, and less likely to be mixed, and that can provide a clearer sense of orientation.

Here, for pseudo surround sound signals produced by creating three or more types of sound signals from a sound source recording less than three types of sound signals (for example, two types of stereo sound signals of right and left), it is possible to input the created sound signals respectively from left sound source 29, right sound source 31, and center sound source 37. With this, it is possible to produce a three-dimensional sound field only by the loudspeaker pairs positioned ahead of listener 27, without providing normal loudspeakers around listener 27 as in the conventional surround sound loudspeaker system.

With the configuration and the operation described above, it is possible to produce the sound fields that are independent and less likely to be mixed by the right, left, and center loudspeaker pairs each including loudspeaker 11 and superdirective speaker 13, and therefore listener 27 is able to hear sound with a three-dimensional effect providing a clearer sense of orientation. Thus, it is possible to realize the sound reproduction device capable of producing a sense of orientation and a three-dimensional effect without providing a large number of loudspeakers around listener 27.

While the loudspeaker pairs each including loudspeaker 11 and superdirective speaker 13 are placed on TV rack 39 according to the third exemplary embodiment, the present invention is not limited to such an example, and can be applicable as a loudspeaker system and the like for audio.

Fourth Exemplary Embodiment

Figure 7:
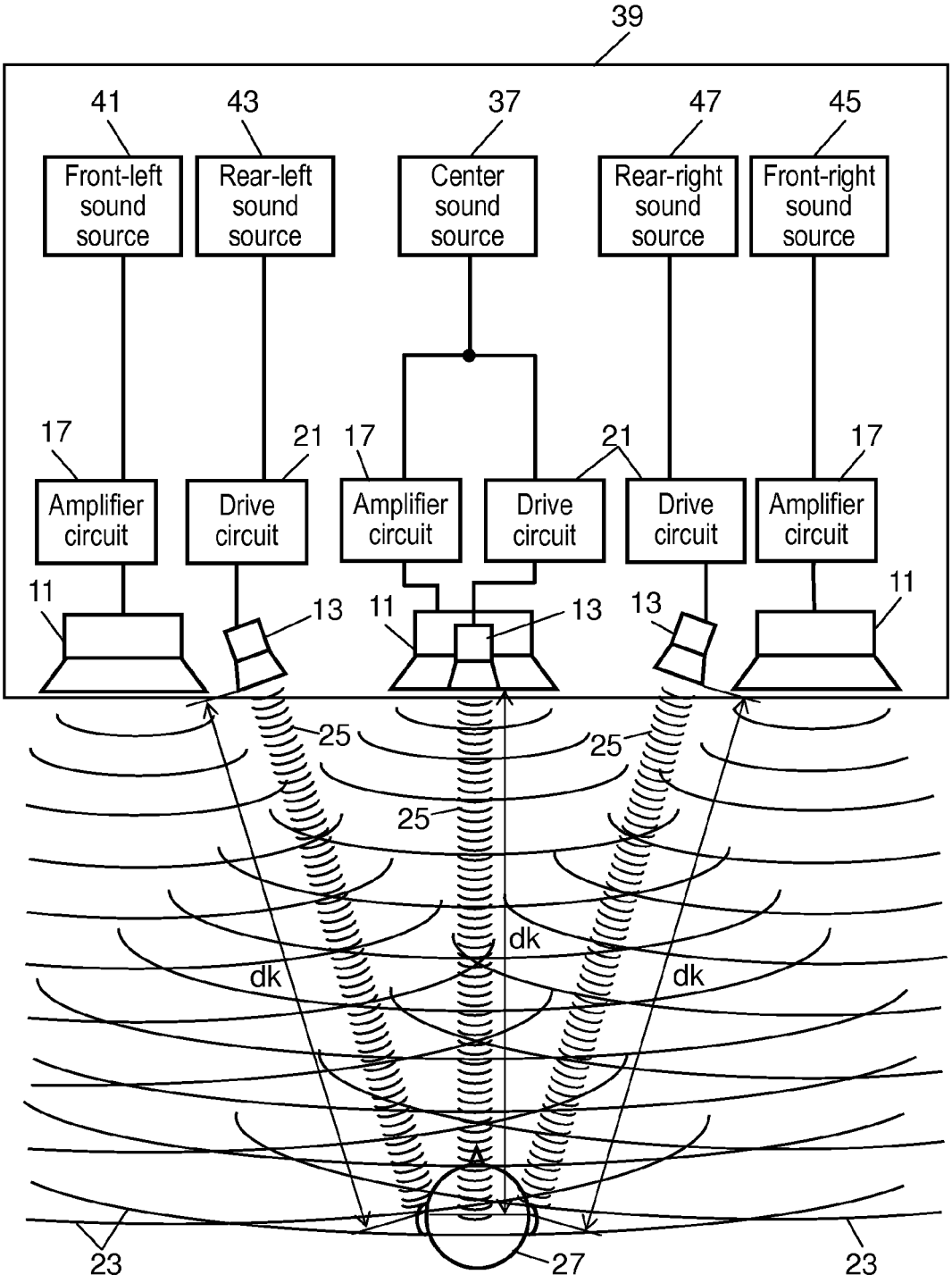
FIG. 7 is a block diagram of a sound reproduction device according to a fourth exemplary embodiment of the present invention.

FIG. 7 is a block diagram of a sound reproduction device according to a fourth exemplary embodiment of the present invention, and a position and a facing direction of the listener are also shown in FIG. 7.

In FIG. 7, like reference numerals designate like components as those of the sound reproduction device illustrated in FIG. 6, and detailed descriptions for these components shall be omitted. Specifically, as illustrated in FIG. 7, characteristics of the sound reproduction device according to the fourth exemplary embodiment are as listed below.

(1) In one of the loudspeaker pairs that is positioned ahead on the left of listener 27, loudspeaker 11 is electrically connected to front-left sound source 41 via amplifier circuit 17, and superdirective speaker 13 is electrically connected to rear-left sound source 43 via drive circuit 21.

(2) In one of the loudspeaker pairs that is positioned ahead on the right of listener 27, loudspeaker 11 is electrically connected to front-right sound source 45 via amplifier circuit 17, and superdirective speaker 13 is electrically connected to rear-right sound source 47 via drive circuit 21.

Other than the above, the configuration is the same as that of the third exemplary embodiment.

When 5.1 channel surround sound signals are inputted to the sound reproduction device thus configured, sound signals from front-left sound source 41 and front-right sound source 45 are respectively reproduced through loudspeakers 11 ahead on the left and right of listener 27. Further, sound signals from rear-left sound source 43 and rear-right sound source 47 are respectively reproduced through superdirective speakers 13 ahead on the left and right of listener 27. Moreover, a sound signal from center sound source 37 is reproduced through loudspeaker 11 and superdirective speaker 13 included in the loudspeaker pair ahead on the center of listener 27. Furthermore, a low-pitched sound signal is reproduced from a subwoofer that is not depicted.

Listener 27 is able to obtain a clear sense of orientation in the right and left by reproducing the sound signals from rear-left sound source 43 and rear-right sound source 47 through superdirective speakers 13 that are positioned ahead on the left and right of listener 27, as the sound pressure peak of the audible sound in superdirective speaker sound field 25 is positioned near listener 27, and mutual interference between the reproduced sound of the sound signals from rear-left sound source 43 and rear-right sound source 47 is smaller than that in loudspeaker sound field 23. Further, the sound signal from center sound source 37 reproduced through superdirective speaker 13 in the loudspeaker pair ahead on the center of listener 27 is independent and less likely to be mixed into the sound field reproduced from the right and left loudspeaker pairs and the subwoofer, and therefore clearly transmitted to listener 27.

With the configuration and the operation described above, it is possible to constitute a 5.1 channel surround loudspeaker system using the sound reproduction device according to the fourth exemplary embodiment without providing conventional speakers around listener 27. Further, it is possible to realize the sound reproduction device capable of reproducing surround sound with a higher sense of independence of the reproduced sound of the rear sound signal on the right and left and clarity of the reproduced sound of the center sound signal, as compared to a surround sound loudspeaker system constituted only by conventional speakers.

While the description is given regarding the 5.1 channel surround sound signals in the fourth exemplary embodiment, it is possible to employ a configuration in which for the surround sound source recording at least three types of sound signals inputted to the sound reproduction device, at least one sound signal out of the sound signals of the surround sound source other than a left-channel signal and a right-channel signal can be reproduced through superdirective speaker 13 that is positioned facing in the same direction as loudspeaker 11 that reproduces the left-channel signal and the right-channel signal to listener 27. With this, it is possible to produce a three-dimensional sound field without providing a loudspeaker in a direction different from the loudspeaker reproducing a left-channel signal and a right-channel signal to listener 27 as in the conventional example.

Further, while the assignment of the sound signals in the surround sound source to the sound sources in the sound reproduction device according to the fourth exemplary embodiment is not limited to the example shown in FIG. 7, it is desirable to employ the above configuration, as a three-dimensional sound field can be produced most appropriately without providing loudspeakers around listener 27 when a sound signal other than a front-left-channel signal and a front-right-channel signal is reproduced through superdirective speaker 13.

Moreover, while the description is given regarding the 5.1 channel surround sound signals in the fourth exemplary embodiment, the present invention is not limited to the 5.1 channel surround sound signals. It is possible to employ a configuration in which a left-channel signal and a right-channel signal are reproduced from loudspeaker 11 and at least one sound signal other than the left-channel signal and the right-channel signal is reproduced from superdirective speaker 13, out of pseudo surround sound signals produced by creating three or more types of sound signals from a sound source recording less than three types of sound signals. With this, it is possible to realize a sound reproduction device capable of reproducing surround sound having a pseudo-three-dimensional effect with a small number of sound signals without providing loudspeakers around listener 27.

Fifth Exemplary Embodiment

Figure 8:
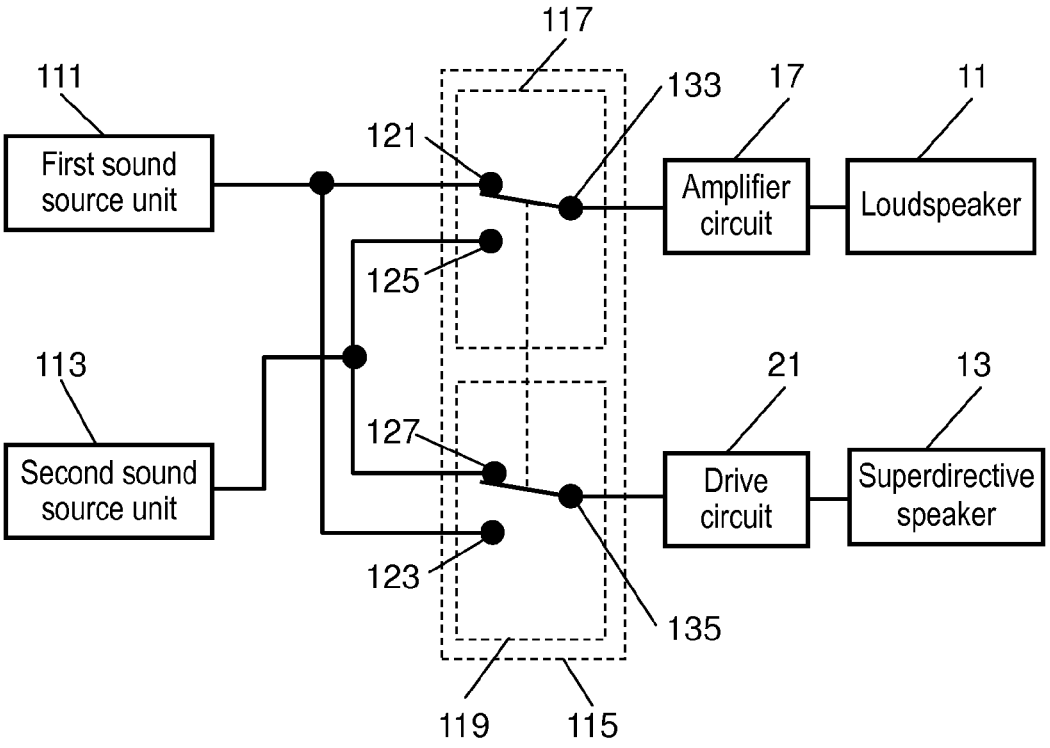
FIG. 8 is a block diagram of a sound reproduction device according to a fifth exemplary embodiment of the present invention.

FIG. 8 is a block diagram of a sound reproduction device according to a fifth exemplary embodiment of the present invention. In FIG. 8, like reference numerals designate like components as those of the sound reproduction device illustrated in FIG. 1, and detailed descriptions for these components shall be omitted.

Referring to FIG. 8, to first sound source unit 111, a sound signal of background sound of the surroundings that is desired to be conveyed to the listener is inputted, for example. Likewise, to second sound source unit 113, a sound signal of sound information that is desired to be conveyed to the listener is inputted, for example. Therefore, sound signals outputted from a plurality of (here, two) sound source units, that is, first sound source unit 111 and second sound source unit 113, are independent from each other.

First sound source unit 111 and second sound source unit 113 are both electrically connected to selector 115. Therefore, the sound signal of the background sound outputted from first sound source unit 111 and the sound signal of the sound information outputted from second sound source unit 113 are both inputted to selector 115. Selector 115 is configured by two 3-terminal switches having 2 input terminals and 1 output terminal that are switched at the same time. These 3-terminal switches may be configured to be switched by an external signal from a relay, a transistor, and such, or may be switched manually. In the former case, it is possible to perform switching by remote control or automatic switching based on an instruction such as sound source data.

As used herein, one of the two 3-terminal switches is referred to as first switching unit 117, and the other is referred to as second switching unit 119. To first sound source selecting terminal 121 of first switching unit 117 and first sound source selecting terminal 123 of second switching unit 119, first sound source unit 111 is electrically connected. Likewise, to second sound source selecting terminal 125 of first switching unit 117 and second sound source selecting terminal 127 of second switching unit 119, second sound source unit 113 is electrically connected.

To an output terminal of selector 115, loudspeaker 11 and superdirective speaker 13 are electrically connected. Referring to FIG. 8, first common terminal 133 of first switching unit 117 is connected to loudspeaker 11 via amplifier circuit 17, and second common terminal 135 of second switching unit 119 is connected to superdirective speaker 13 via drive circuit 21.

Here, loudspeaker 11 is a conventional speaker, and a sound pressure of audible sound emitted from the loudspeaker is maximized near the loudspeaker, and decreases as the sound travels farther away from a position of the loudspeaker.

Further, superdirective speaker 13 is a loudspeaker using an ultrasonic wave as a carrier wave. When an ultrasonic wave superimposed over an audible sound component is emitted from the superdirective speaker, the audible sound component is reproduced by an effect of the non-linear characteristic of elastic characteristic of air. Accordingly, the sound pressure of the audible sound from the superdirective speaker exhibits a characteristic dependent on a distance along the sound axis such that the sound pressure is very small near the superdirective speaker along the sound axis in which the ultrasonic wave travels, increases as the audible sound travels through the air to a peak at a predetermined distance from the superdirective speaker. Moreover, also in a direction vertical to a sound axis, the sound pressure of the audible sound from the superdirective speaker exhibits a characteristic dependent on a distance from the sound axis, such that the sound pressure of the audible sound from the superdirective speaker decreases as the position is farther away from the sound axis depending on a degree of directionality of the ultrasonic wave used as a carrier wave.

Positions of loudspeaker 11 and superdirective speaker 13 are the same as those described according to the first exemplary embodiment and the second exemplary embodiment.

With the above configuration, any sound signal, out of the sound signals outputted from the plurality of sound source units, that is, first sound source unit 111 and second sound source unit 113, can be selected for loudspeaker 11 and superdirective speaker 13 using the selector 115.

Next, an operation of the sound reproduction device thus configured will be described.

When the sound signals described above are inputted to the respective sound sources, the sound signal of the background sound is outputted from first sound source unit 111, and the sound signal of the sound information is outputted from second sound source unit 113, independently.

Here, as illustrated in FIG. 8, in selector 115, in order to output the background sound from loudspeaker 11 and the sound information from superdirective speaker 13, first switching unit 117 selects first sound source selecting terminal 121 and second switching unit 119 selects second sound source selecting terminal 127.

At this time, by the listener (not depicted) being present at a position where the superdirective speaker sound field of the audible sound produced from superdirective speaker 13 overlaps with the loudspeaker sound field of the audible sound produced from loudspeaker 11, the listener is able to clearly hear the sound information from superdirective speaker 13 in the background sound from loudspeaker 11.

This is because as the sound field is produced by overlapping the sound field of loudspeaker 11 produced only by an audible sound component with the sound field of the audible sound of superdirective speaker 13 reproduced by using the ultrasonic wave as a carrier wave, the proportion of interference between the audible sound is reduced as compared to the sound field produced from the normal loudspeakers.

Further, when outputting the sound information from loudspeaker 11 and the background sound from superdirective speaker 13 according to contents of the plurality of sound sources, it is possible to select selector 115 such that first switching unit 117 selects second sound source selecting terminal 125 and second switching unit 119 selects first sound source selecting terminal 123.

Using selector 115 in this manner, it is possible to select the sound signals from first sound source unit 111 and second sound source unit 113 independently for loudspeaker 11 and superdirective speaker 13. With this, it is possible to produce a three-dimensional sound field in which the sound is independent without providing normal loudspeakers around the listener. In addition, it is possible to realize a sound reproduction device capable of selecting the sound source according to the contents of the plurality of sound sources.

Sixth Exemplary Embodiment

Figure 9:
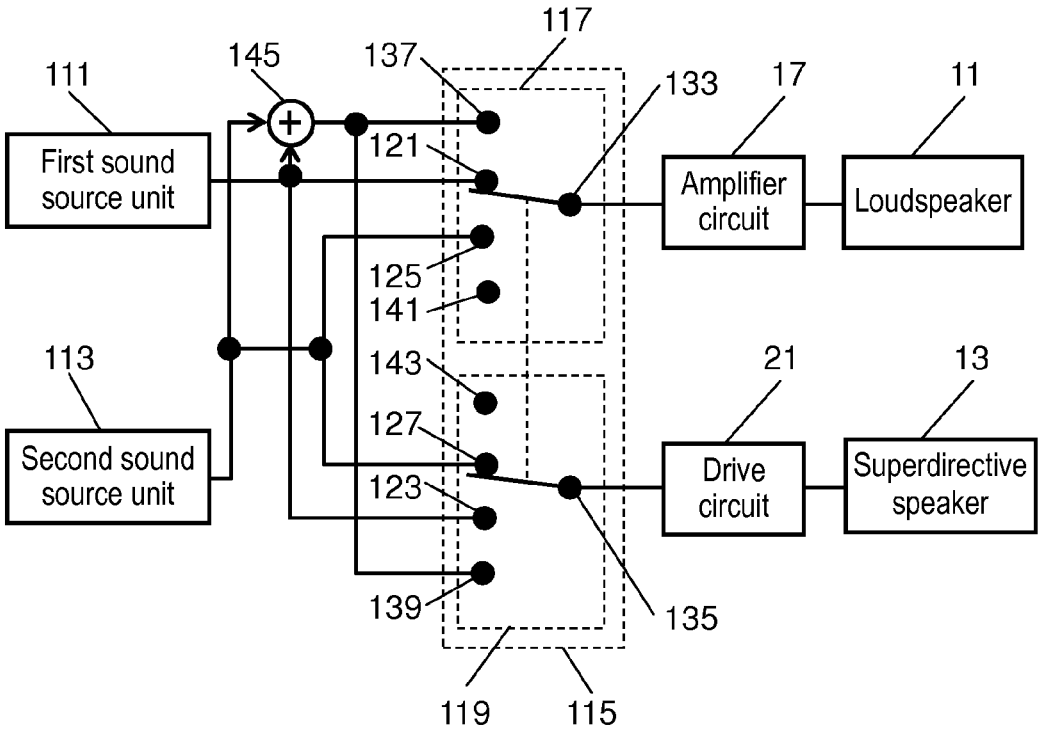
FIG. 9 is a block diagram of a sound reproduction device according to a sixth exemplary embodiment of the present invention.
Figure 10:
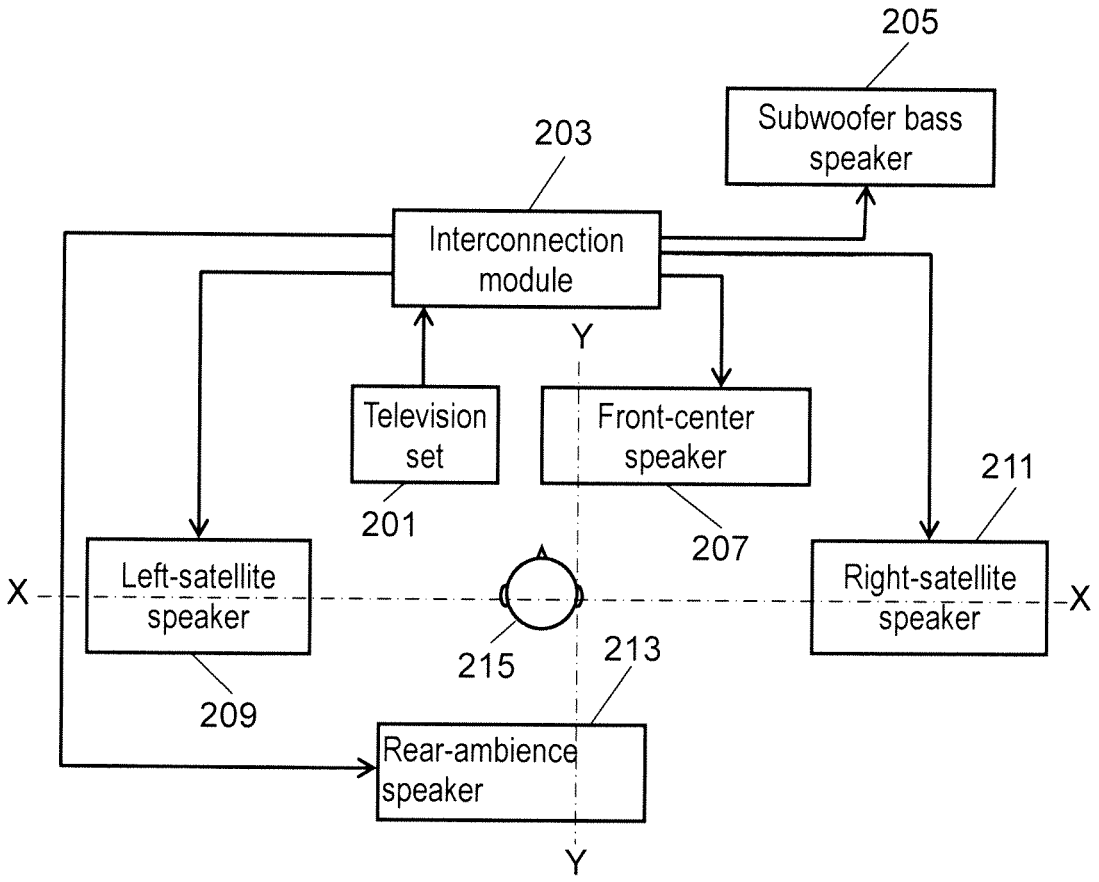
FIG. 10 PRIOR ART
FIG. 10 is a block diagram of a conventional surround sound speaker system.
Figure 11A:
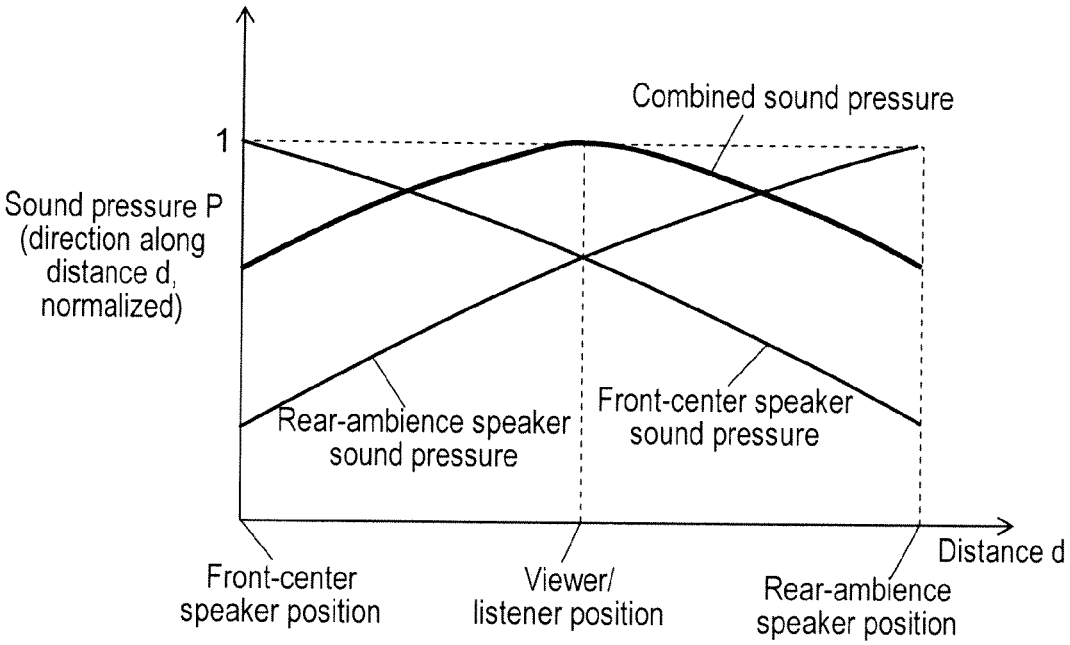
FIG. 11A PRIOR ART
FIG. 11A is a sound pressure characteristic diagram of the conventional surround sound speaker system, with respect to distance d in a front-back direction to a viewer/listener.
Figure 11B:
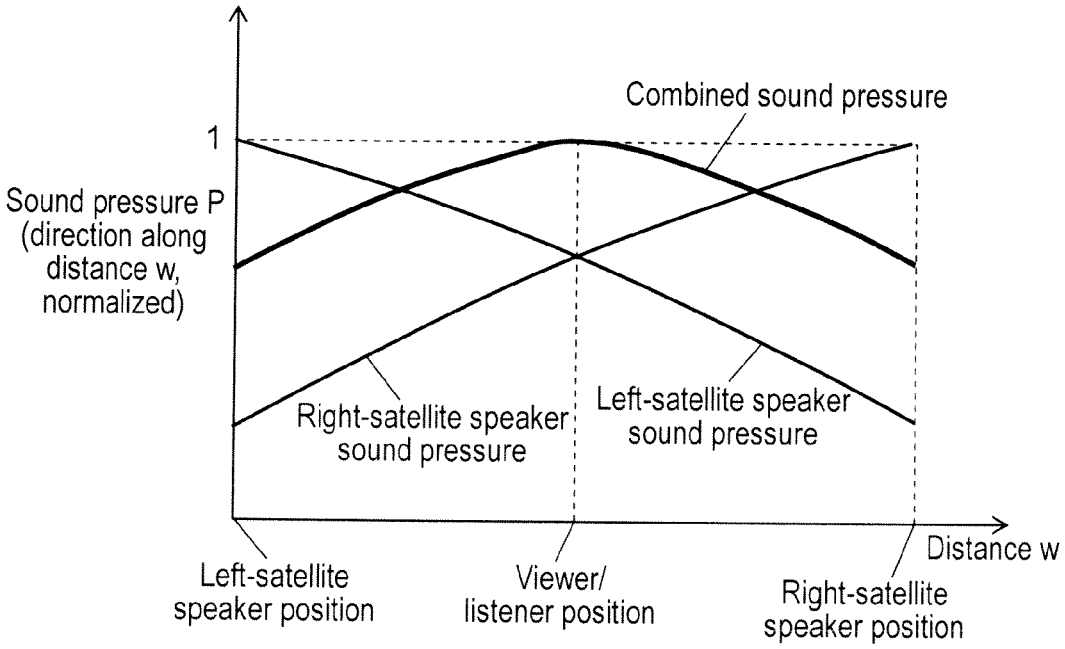
FIG. 11B PRIOR ART
FIG. 11B is a sound pressure characteristic diagram of the conventional surround sound speaker system, with respect to distance w in a right-left direction of a viewer/listener.
Figure 12:
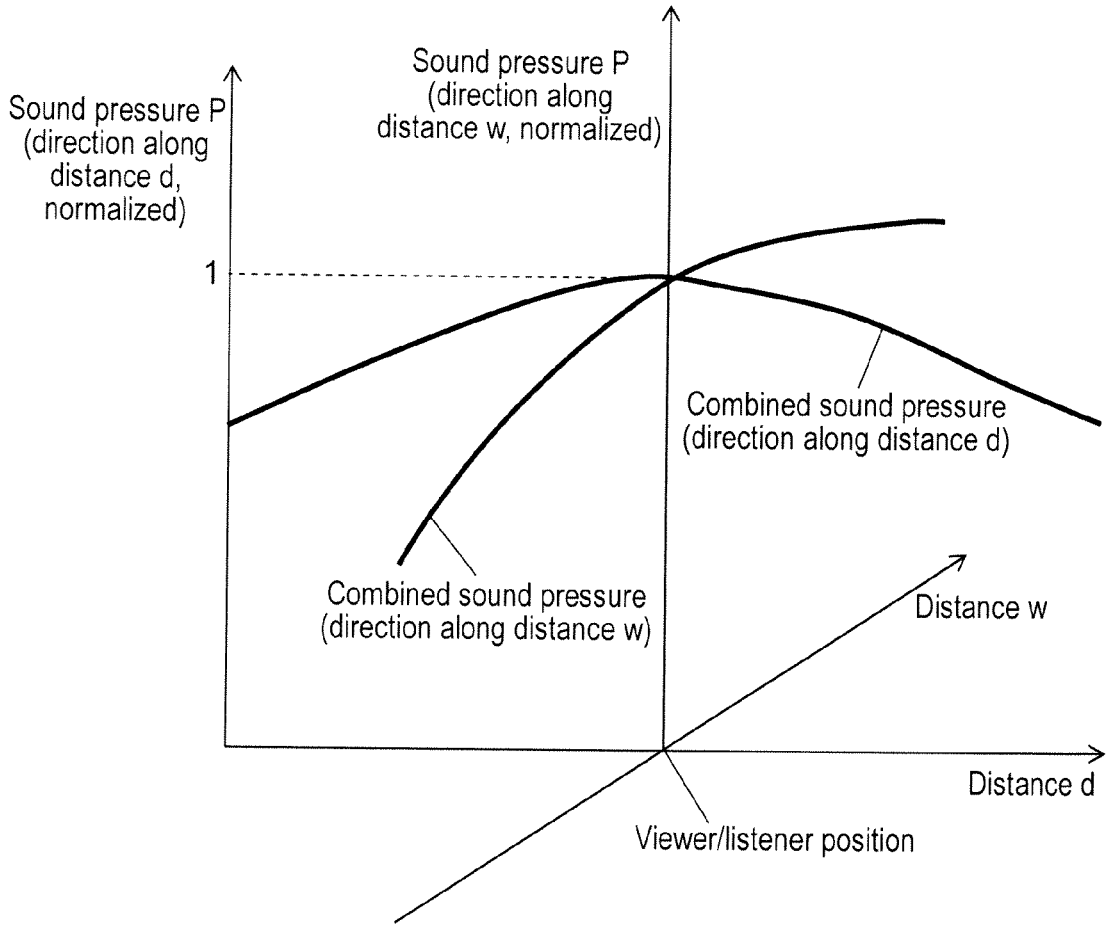
FIG. 12 PRIOR ART
FIG. 12 is a sound pressure characteristic diagram of the conventional surround sound speaker system, with respect to distance d in the front-back direction to the viewer/listener and distance w in the right-left direction of the viewer/listener.

FIG. 9 is a block diagram of a sound reproduction device according to a sixth exemplary embodiment of the present invention.

In FIG. 9, like reference numerals designate like components as those of the sound reproduction device illustrated in FIG. 8, and detailed descriptions for these components shall be omitted. Specifically, as illustrated in FIG. 9, characteristics of the sound reproduction device according to the sixth exemplary embodiment are as listed below.

(1) First switching unit 117 and second switching unit 119 of selector 115 are each configured as a 5-terminal switches having 4 input terminals and 1 output terminals.

(2) The 4 input terminals of first switching unit 117 are combined sound source selecting terminal 137 and non-selecting terminal 141, in addition to first sound source selecting terminal 121 and second sound source selecting terminal 125. The 4 input terminals of second switching unit 119 are combined sound source selecting terminal 139 and non-selecting terminal 143, in addition to first sound source selecting terminal 123 and second sound source selecting terminal 127. Here, non-selecting terminal 141 and non-selecting terminal 143 are not directly connected to any of the sound sources.

(3) Synthesizer 145 is electrically connected between first sound source unit 111 and selector 115. Here, synthesizer 145 has a function of synthesizing a plurality of sound signals (a sound signal from first sound source unit 111 and a sound signal from second sound source unit 113 in the sixth exemplary embodiment) and a generation is outputted.

(4) An output terminal of synthesizer 145 is electrically connected to combined sound source selecting terminal 137 and combined sound source selecting terminal 139. Therefore, selector 115 has a function of allowing selection between sound signals from the sound source units including an output from synthesizer 145.

Here, first switching unit 117 and second switching unit 119 have a function of switching the same position in the 4 input terminals illustrated in FIG. 9 at the same time. Specifically, if first switching unit 117 selects combined sound source selecting terminal 137 that is an uppermost terminal in FIG. 9, second switching unit 119 selects non-selecting terminal 143 that is an uppermost terminal in FIG. 9 at the same time.

Next, an operation of the sound reproduction device thus configured will be described.

First, when selector 115 selects first sound source selecting terminal 121 and second sound source selecting terminal 127, a sound signal from first sound source unit 111 is outputted through loudspeaker 11 via amplifier circuit 17, and a sound signal from second sound source unit 113 is outputted through superdirective speaker 13 via drive circuit 21.

Then, when selector 115 selects first sound source selecting terminal 123 and second sound source selecting terminal 125, the sound signal from second sound source unit 113 is outputted through loudspeaker 11 via amplifier circuit 17, and the sound signal from first sound source unit 113 is outputted through superdirective speaker 13 via drive circuit 21. Specifically, the operation is the same as that in the fifth exemplary embodiment, and the listener at a position where a sound field produced from loudspeaker 11 overlaps with a sound field produced from the audible sound from superdirective speaker 13 is able to hear the sound in the same manner as in the fifth exemplary embodiment.

Next, when selector 115 selects combined sound source selecting terminal 137 and non-selecting terminal 143, a sound signal resulting from the sound signal from first sound source unit 111 and the sound signal from second sound source unit 113 combined by synthesizer 145 is outputted through loudspeaker 11 via amplifier circuit 17. At this time, drive circuit 21 does not operate as no sound signal is inputted to drive circuit 21, and superdirective speaker 13 does not output any signal.

Specifically, as the sound signal resulting from the combination of the sound signal from first sound source unit 111 and the sound signal from second sound source unit 113 is reproduced through loudspeaker 11 as a conventional speaker, the listener is able to hear the sound reproduced from loudspeaker 11 in a wider area as compared to the case in which the sound is reproduced only from the superdirective speaker.

Finally, when selector 115 selects non-selecting terminal 141 and combined sound source selecting terminal 139, a sound signal resulting from the sound signal from first sound source unit 111 and the sound signal from second sound source unit 113 combined by synthesizer 145 is outputted through superdirective speaker 13 via drive circuit 21. At this time, amplifier circuit 17 does not operate as no sound signal is inputted to amplifier circuit 17, and loudspeaker 11 does not output any signal.

Specifically, as the sound signal resulting from the combination of the sound signal from first sound source unit 111 and the sound signal from second sound source unit 113 is reproduced through superdirective speaker 13, the listener is able to hear the sound reproduced from superdirective speaker 13 in a narrower area as compared to the case in which the sound is reproduced only from the normal loudspeaker. Further, less sound may be transmitted to a person in a sound field other than the sound field of the audible sound reproduced from superdirective speaker 13, who does not need the sound from superdirective speaker 13.

In addition, as the audible sound reproduced from superdirective speaker 13 is less likely to be mixed or interfere with environmental sound around the listener as compared to the audible sound from normal loudspeaker 11, an effect that the audible sound reproduced from superdirective speaker 13 can be heard more clearly than the audible sound from normal loudspeaker 11 is provided.

Further, as compared to a case in which the listener wears headphones, the listener is able to hear the reproduced audible sound without a sense of restraint and cumbersomeness.

With the configuration and the operation described above, by reproducing the sound optionally selected by selector 115 according to contents of the plurality of sound sources from loudspeaker 11 and superdirective speaker 13 that are positioned facing in the same direction with respect to the listener without providing normal loudspeakers around the listener, it is possible to realize a sound reproduction device capable producing a three-dimensional sound field around the listener and of allowing the listener to hear the sound reproduced from superdirective speaker 13 independently and clearly against the sound reproduced from loudspeaker 11.

The sound reproduction device according to any of the fifth exemplary embodiment and the sixth exemplary embodiment can be applied to television set 35 described according to the second exemplary embodiment, TV rack 39 described according to the third exemplary embodiment and the fourth exemplary embodiment, the 5.1-channel surround loudspeaker system described according to the fourth exemplary embodiment, the loudspeaker system for audio, or the like.

Further, the sound reproduction device according to any of the fifth exemplary embodiment and the sixth exemplary embodiment may have a balancing function for adjusting magnitudes of the signals outputted from amplifier circuit 17 and drive circuit 21. With this, it is possible to increase a margin for adjustment of the three-dimensional effect according to contents of the plurality of sound sources, and it is possible to provide a three-dimensional effect best suited for the listener.

Moreover, it is possible to install loudspeaker 11 and superdirective speaker 13 or the loudspeaker pair including these loudspeakers according to the first exemplary embodiment to the sixth exemplary embodiment in a vehicle. In this case, it is possible to reduce the weight of the vehicle as it is possible to reduce the number of loudspeakers as compared to a conventional configuration in which a large number of conventional speakers are provided around a driver within a vehicle interior. In addition, as a position of listener 27 such as the driver is almost fixed within the vehicle interior, there is a particular advantage that the facing direction of superdirective speaker 13 can be easily set univocally in the adjustment.

Furthermore, in a small vehicle interior, when a surround sound loudspeaker system is configured using only normal loudspeakers 11 with a large radiation angle, there is a case in which it is not possible to produce a sufficient surround effect as sound from the loudspeakers interfere with each other and the sound reflect on wall surfaces in the vehicle. By contrast, by using the loudspeaker pair including loudspeaker 11 and superdirective speaker 13, it is possible to produce the sound field around the ears of listener 27 such as the driver, and therefore listener 27 is able to hear the sound with a higher surround effect in the vehicle interior.

In the description from the first exemplary embodiment to the sixth exemplary embodiment, loudspeaker 11 and superdirective speaker 13 are positioned side by side. However, as long as loudspeaker sound field 23 and superdirective speaker sound field 25 overlap near listener 27, and as long as the peak of sound pressure P in superdirective speaker sound field 25 is positioned near listener 27, it is possible to position loudspeaker 11 and superdirective speaker 13 displacing backward and forward from each other, or at positions distant from each other. However, it is desirable to position loudspeaker 11 and superdirective speaker 13 side by side, as the sound from these loudspeakers are less interfering with each other as compared to conventional speakers even when loudspeaker 11 and superdirective speaker 13 are close to each other, and as it is advantageous in downsizing an entire system including these loudspeakers.

Further, the applications of the sound reproduction device according to any of the first exemplary embodiment to the sixth exemplary embodiment are not limited to television set 35, TV rack 39, and the audio (including an in-car application). The sound reproduction device according to any of the first exemplary embodiment to the sixth exemplary embodiment may be applied to portable devices such as mobile telephones, portable music players, portable television sets, portable DVD players, and handheld gaming machines, as well as devices that handle sound for personal computers and such.

INDUSTRIAL APPLICABILITY

According to the sound reproduction device of the present invention, the sound pressures of audible sound produced from the loudspeaker and the superdirective speaker are maximized near the listener, and the listener is able to hear the sound with a three-dimensional effect, and therefore the sound reproduction device according to the present invention is in particular advantageous as a sound reproduction device capable of producing a three-dimensional sound field with a smaller number of loudspeakers.

REFERENCE MARKS IN THE DRAWINGS

11 loudspeaker
13 superdirective speaker
23 loudspeaker sound field
25 superdirective speaker sound field
27 listener
111 first sound source unit
113 second sound source unit
115 selector

The invention claimed is:

1. A sound reproduction device comprising:
a loudspeaker; and
a superdirective speaker, wherein:
the loudspeaker is configured so that a sound pressure of audible sound produced therefrom decreases as the sound travels farther away from the loudspeaker,
the superdirective speaker is configured so that a sound pressure of audible sound produced therefrom has a peak at a predetermined distance from the superdirective speaker, and is configured to use an ultrasonic wave as a carrier wave, and
the loudspeaker and the superdirective speaker are positioned such that a first wave emitted from the loudspeaker and a second wave emitted from the superdirective speaker directly reach a position of a listener, wherein the peak is produced at the position of the listener to allow the listener to hear the sound from the superdirective speaker more clearly than the sound from the loudspeaker.

2. The sound reproduction device according to claim 1, wherein a first sound field of the loudspeaker and a second sound field of the superdirective speaker include a portion at which the sound pressure of the audible sound produced from the superdirective speaker is greater than the sound pressure of the audible sound produced from the loudspeaker at the position of the listener.

3. The sound reproduction device according to claim 1, wherein, when the sound reproduction device receives a surround sound source recording at least three types of sound signals, at least one of the sound signals, other than a left-channel signal and a right-channel signal, is reproduced through the superdirective speaker.

4. The sound reproduction device according to claim 1, wherein, when the sound reproduction device produces a pseudo surround sound source having three or more types of sound signals generated from a sound source having less than three types of sound signals, at least one of the sound signals in the pseudo surround sound source, other than a left-channel signal and a right-channel signal, is reproduced through the superdirective speaker.

5. The sound reproduction device according to claim 1, further comprising:
a plurality of sound source units configured to respectively output sound signals that are different from each other; and
a selector electrically connected to the sound source units and configured to receive the sound signals, the selector comprising a first output terminal and a second output terminal,
wherein the selector is configured to select electrical connections between the plurality of sound source units, and the loudspeaker and the superdirective speaker.

6. The sound reproduction device according to claim 5, wherein the selector is configured to independently select the electrical connections between the plurality of sound source units, and the loudspeaker and the superdirective speaker.

7. The sound reproduction device according to claim 5, wherein:
the plurality of sound source units includes a first sound source unit for outputting a first sound signal, and a second sound source unit for outputting a second sound signal, and
the selector is configured to select one of the following connections:
connection (1) in which the first sound signal is outputted to the loudspeaker and the second sound signal is outputted to the superdirective speaker; and
connection (2) in which the second sound signal is outputted to the loudspeaker and the first sound signal is outputted to the superdirective speaker.

8. The sound reproduction device according to claim 5, wherein:
the plurality of sound source units includes a first sound source unit for outputting a first sound signal, and a second sound source unit for outputting a second sound signal, and
the selector is configured to select one of the following connections:
connection (1) in which the first sound signal is outputted to the loudspeaker and the second sound signal is outputted to the superdirective speaker;
connection (2) in which the second sound signal is outputted to the loudspeaker and the first sound signal is outputted to the superdirective speaker;
connection (3) in which a mixed signal of the first sound signal and the second sound signal is outputted to the loudspeaker; and
connection (4) in which the mixed signal of the first sound signal and the second sound signal is outputted to the superdirective speaker.

9. The sound reproduction device according to claim 5, wherein the loudspeaker and the superdirective speaker are positioned side by side.

10. The sound reproduction device according to claim 5, wherein two or more speaker pairs including the loudspeaker and the superdirective speaker are positioned side by side with the loudspeaker is positioned along a single plane facing the listener.

11. The sound reproduction device according to claim 1, wherein the loudspeaker and the superdirective speaker are positioned side by side.

12. The sound reproduction device according to claim 1, wherein two or more speaker pairs including the loudspeaker and the superdirective speaker are positioned side by side with the loudspeaker is positioned along a single plane facing the listener.

* * * * *